US007980860B2

(12) United States Patent
Yu et al.

(10) Patent No.: US 7,980,860 B2
(45) Date of Patent: Jul. 19, 2011

(54) POWER CONNECTOR ASSEMBLY

(75) Inventors: Wang-I Yu, Jhonghe (TW); Hung-Chi Tai, Jhonghe (TW)

(73) Assignee: Alltop Electronics (Su Zhou) Co., Ltd, Taicang, Jiangsu Province (CN)

( * ) Notice: Subject to any disclaimer, the term of this patent is extended or adjusted under 35 U.S.C. 154(b) by 267 days.

(21) Appl. No.: 12/190,955

(22) Filed: Aug. 13, 2008

(65) Prior Publication Data

US 2009/0275218 A1 Nov. 5, 2009

(30) Foreign Application Priority Data

Apr. 30, 2008 (CN) ..... 2008 1 0084000

(51) Int. Cl.
*H01R 12/00* (2006.01)

(52) U.S. Cl. ..... 439/65

(58) Field of Classification Search ..... 439/65, 439/78–79, 692, 825–827
See application file for complete search history.

(56) References Cited

U.S. PATENT DOCUMENTS

| | | | | |
|---|---|---|---|---|
| 5,215,471 | A * | 6/1993 | Reymond et al. | 439/66 |
| 5,431,576 | A * | 7/1995 | Matthews | 439/247 |
| 6,319,075 | B1 | 11/2001 | Clark et al. | |
| 6,568,943 | B2 * | 5/2003 | Okayasu et al. | 439/76.1 |
| 7,458,839 | B2 * | 12/2008 | Ngo et al. | 439/291 |
| 7,666,025 | B2 * | 2/2010 | Cheng et al. | 439/485 |
| 2008/0146091 | A1 * | 6/2008 | Tyler | 439/843 |

OTHER PUBLICATIONS

CN 200820031892.1.

* cited by examiner

*Primary Examiner* — Edwin A. Leon
(74) *Attorney, Agent, or Firm* — Sughrue Mion, PLLC

(57) ABSTRACT

A power connector, includes an insulating housing having a plurality of contact receiving passages, each of said plurality of contact receiving passages receives a contact pair having a pair of independent conductive contacts, wherein said independent conductive contact includes a first part made of high conductive material and a second part made of high mechanical material, said first part is connected with said second part by a positioning element, said supporting portion of said second part keeps said first part from over deforming when a force is applied on said contacting portion for power transmission, so as to ensure the stability of power transmission.

19 Claims, 5 Drawing Sheets

POWER CONNECTOR ASSEMBLY

BACKGROUND OF THE INVENTION

1. Field of the Invention

The present invention relates to a power connector, and more particularly to an assembly of a receptacle and a plug connectors for transmitting power between circuit boards.

2. Description of Related Art

Designers of electronic circuits generally are concerned with two basic circuit portions, the logic or signal portion and the power portion. In designing logic circuits, the designer usually does not have to take into account any changes in electrical properties, such as resistance of circuit components that are brought about by changes in conditions, such as temperature, because current flows in logic circuits are usually relatively low. However, power circuits can undergo changes in electrical properties because of the relatively high current flows. Consequently, connectors designed for use in power circuits must be capable of dissipating heat (generated primarily as a result of the Joule effect) so that changes in circuit characteristics as a result of changing current flow are minimized U.S. Pat. No. 6,319,075 discloses a power connector assembly used in power transmission application, which includes a receptacle connector and a mating plug connectors assembled on a circuit board, said receptacle connector includes an insulating receptacle housing and receptacle contact assembly assembled in said insulating receptacle housing, said plug connector has an insulating plug housing and plug contact assembly assembled in said insulating plug housing. Referring to FIG. 1, each of said receptacle contact 10 includes two pieces of planar base portions 12, 14 connected on the top, and an upper and a lower curved contacting arms 16, 20 extending forwardly from the front of said base portion. When said receptacle connector is mated with said plug connector to be electrically connected, said plug and said receptacle contacting arms resiliently contact with each other, said receptacle contact 10 deforms under the pressing force when said plug contact being inserted, while the U shaped connection portion 42, 44 on top of said planar base portions 12, 14 of said receptacle contact 10 can provide an opposite supportive force to keep the contacting portion of said receptacle contact 10 from over deforming. Also, the receptacle as disclosed in this patent is configured in one piece, the connection portion of said base portion of the contact is U shaped, which needs to be bent after the base portion of the contact has been stamped, the process of bending normally results in a crack of the contact at a position where is bent, consequently the electrical conductive characteristics of the material could be influenced and the quality could be affected also. Moreover, the high temperature during welding could also cause the relief of the inner metal stress of the bent contact, which could influence the precision of welding foot of the contact due to the expanding of the contact, as a result, the contact could not be smoothly contacted with circuit board or the welding foot of the contact could also be broken.

To overcome the disadvantages as disclosed in this patent, another Chinese Utility Model patent No. 200820031892.1 of the present applicant on an invention of a power connector assembly and mating contacts used thereof discloses an improved receptacle contact. Referring to FIG. 2, each of the receptacle contact pair 220 includes a pair of independent receptacle contacts 221, 222. Each of the receptacle contacts includes a rectangular planar base portion, a mounting leg extending downwardly from said base portion, and a contacting arm extending forwardly from said base portion. Said receptacle contact is configured in two pieces and manufactured directly by injection mould without the above problems occurred during bending process, therefore the quality can be effectively improved while the cost of manufacturing can be reduced, also it can be easily assembled, the manufacturing process becomes simple while the quality can be stabilized. In addition, because no connection or support is provided between said receptacle contacts 221, 222, the contacting arm of said receptacle contact intends to be over deformed or crumpled due to the pressing force exerted when the plug contact is inserted into the contacting arm of the receptacle contacts 221, 222, therefore the performance of power transmission of the receptacle contacts could be influenced.

Therefore, there are still some rooms that could be further improved about the configuration of the contact used in the power connector.

SUMMARY OF THE INVENTION

Accordingly, an object of the present invention is to provide a power connector, the improved design of a contact increases the stability and reliability of the power transmission of said power connector.

In order to achieve above mentioned object, a power connector according to one of the preferred embodiments of the present invention includes an insulating housing having a plurality of contact receiving passages, each of said plurality of contact receiving passages receives a contact pair having a pair of independent conductive contacts, wherein said independent conductive contact includes a first part made of high conductive material and a second part made of high mechanical material. Said first part is connected with said second part by a positioning element.

As an advantageous embodiment of the present invention, said first part includes a base portion and a contacting portion extending from said base portion. Said second part includes a securing portion contacted with said base portion of said first part and a supporting portion extending from said securing portion to contact with said contacting portion of said first part.

As another advantageous embodiment of the present invention, said positioning element includes a first positioning element for connecting said base portion of said first part to said securing portion of said second part, and a second positioning element for connecting said contacting portion of said first part to said supporting portion of said second part. Said first positioning element includes an opening defined on said base portion of said first part and a spring clip defined on said securing portion of said second part to extend into said opening. Said second positioning element includes a bending portion defined at a position where said base portion of said first part is connected with said contacting portion and a stopping portion defined at a position where said securing portion of said second part is connected with said supporting portion, said stopping portion resting on said bending portion.

As a further advantageous embodiment of the present invention, the material of said first part is copper, and the material of said second part is stainless steel.

As another advantageous embodiment of the present invention, said power connector is a receptacle connector, and said contact pairs are receptacle contact pairs received in said contact receiving passages of said insulating receptacle housing of said receptacle connector.

As another preferred embodiment of the present invention, a power connector assembly includes a receptacle connector and a mating plug connector, said receptacle connector includes an insulating receptacle housing and receptacle contact pairs received in contact receiving passages of said insulating receptacle housing, said plug connector having an insulating plug housing and plug contact pairs received in contact receiving passages of said insulating plug housing, wherein each of said receptacle contact pairs has a pair of independent receptacle contacts received in a corresponding contact receiving passage of said insulating receptacle housing, wherein each of said receptacle contact pair includes a first part and a second part connected with each other by a positioning element, wherein the material of the first part is high conductive material, while the material of the second part is high mechanical material.

As another advantageous embodiment of the present invention, said first part of said receptacle contact includes a base portion, a resilient contacting arm extending from said base portion, and a bent portion for connecting said base portion to said contacting arm. Said second part of said receptacle contact includes a securing portion contacted with said base portion of said first part and a supporting portion extending from said securing portion to contact with said contacting arm of said first part.

According to another preferred embodiment of the present invention, a conductive contact includes a first part made of high conductive material and a second part made of high mechanical material. Said first part is connected with said second part by a positioning element.

The technical results of the present invention are as follows. Firstly the contact is configured in two pieces to simplify the manufacturing process while stabilize the quality, so as to improve the distribution of high voltage and current, secondly the contact with a combined structure of said two-piece keeps it from over deforming when being contacted and ensures the reliability of power transmission.

DETAILED DESCRIPTION OF THE INVENTION

Figure 1:
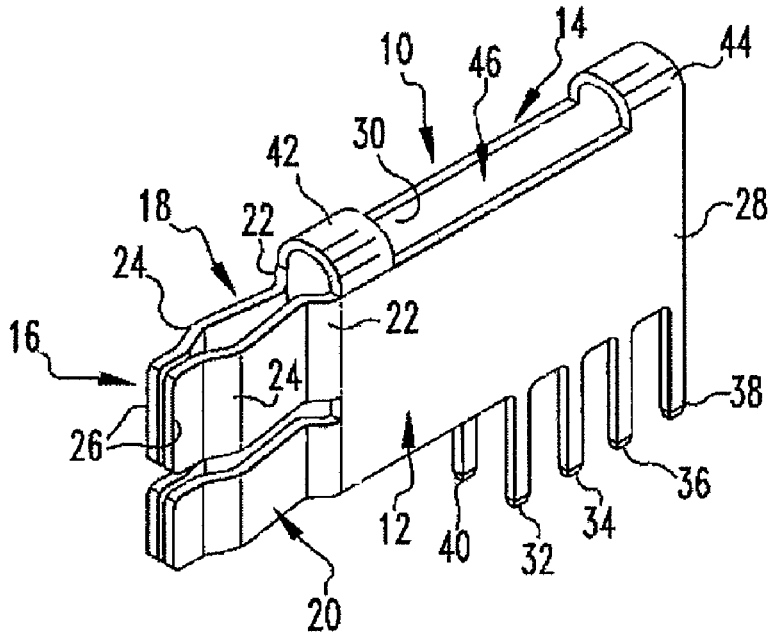
FIG. 1 (Prior art)
FIG. 1 is a perspective view of a conductive contact used in a known power connector.
Figure 2:
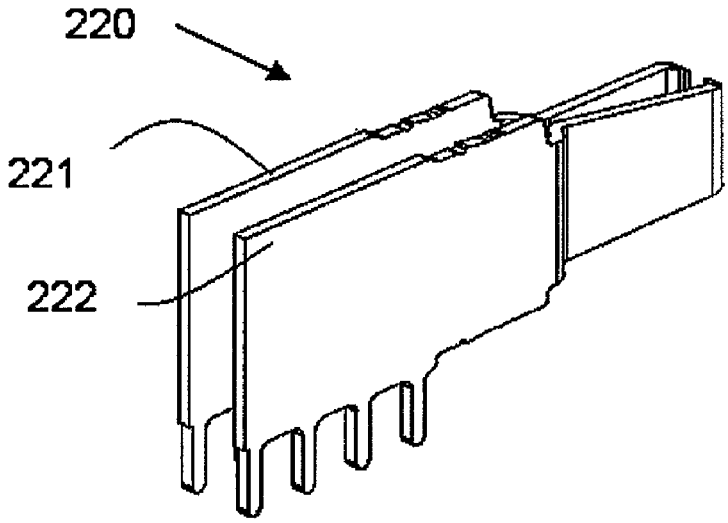
FIG. 2 (Prior art)
FIG. 2 is a perspective view of another conductive contact used in a known power connector.
Figure 3:
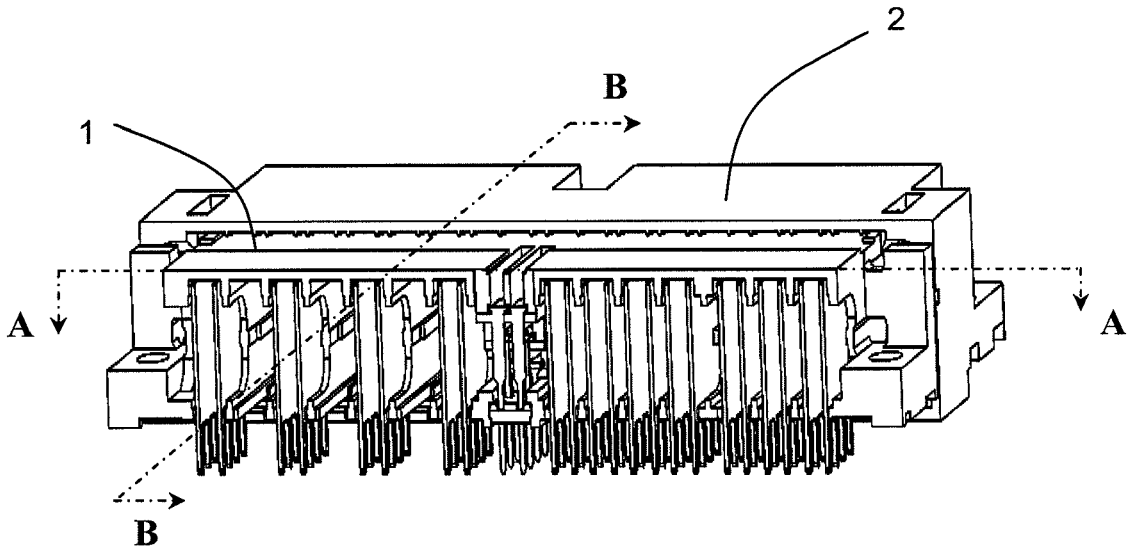
FIG. 3 is a perspective view of an assembly of a receptacle connector mated with a plug connector of a power connector assembly according to the present invention.

Referring to FIG. 3, a power connector assembly according to the present invention includes a pair of mating power connectors, i.e. a first power connector and a second power connector, contacts of each connectors being mated for realizing the transmission of high voltage and current. Said first power connector includes a first insulating housing and a plurality of first power contacts received in said first insulating housing, said second power connector includes a second insulating housing and a plurality of second power contacts received in said second insulating housing. As a preferred embodiment of the present invention, said first power connector is a receptacle connector 2, said second power connector is a plug connector 1, said first power contacts received in said receptacle connector 2 are receptacle contacts, said second power contacts received in said plug connector 1 are plug contacts, said plug connector 1 and said receptacle connector 2 are assembled on one circuit board respectively, and can be mated to be electrically connected for power transmission between two circuit boards.

Figure 4:
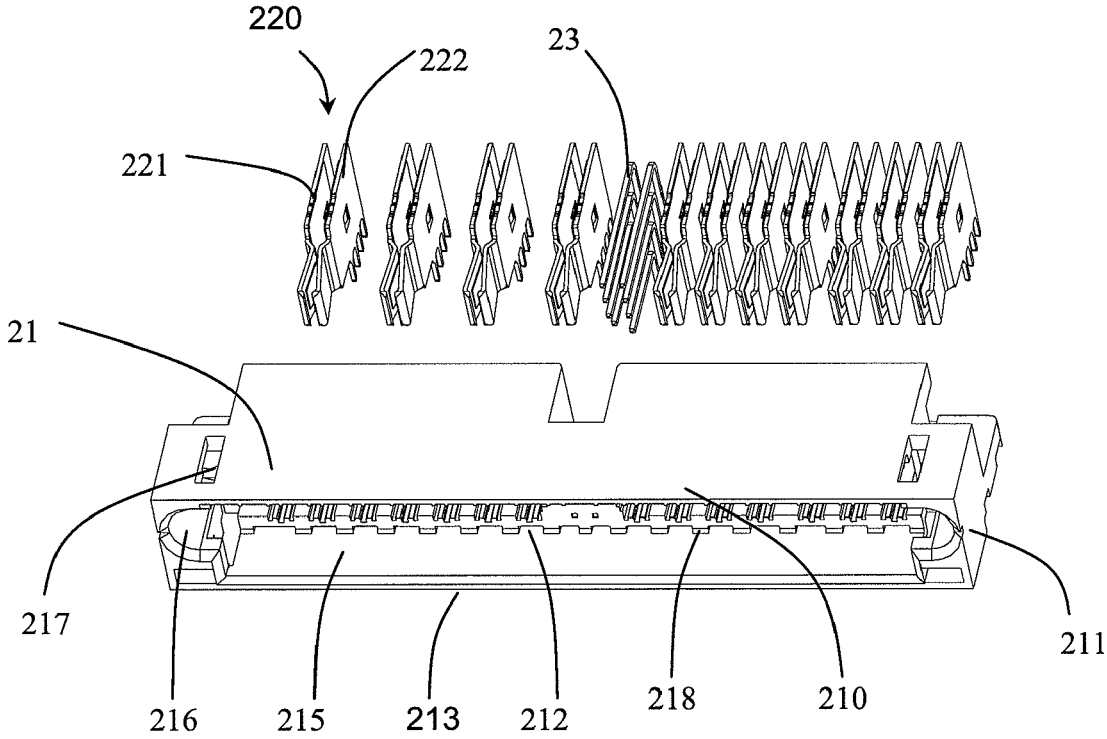
FIG. 4 is an explosively perspective view of a receptacle connector according to the present invention.

Referring to FIG. 4, said receptacle connector 2 includes a insulating receptacle housing 21, a plurality of receptacle contact pairs 220 received in said insulating receptacle housing 21 in an array, and a first signal contact assembly 23. Said first signal contact assembly 23 is inserted in a plurality of through holes arranged near to the middle of said insulating receptacle housing 21 in an array, and includes a plurality of pin type signal contacts arranged in an array for transmitting signals.

As approximately an injection molded longitudinally cubic plastic body; said insulating receptacle housing 21 includes a main body 210 for receiving said contacts and side portion 211 in both side of said main body 210 in a longitudinal direction. Said main body 210 includes a top wall 212 and a parallel bottom wall 213, a middle wall between said top wall 212 and said bottom wall 213, and a longitudinal mating space 215 with an opening in front of said main body 210 formed between said top wall 212 and said bottom wall 213. A through guiding space 216 is defined on said side wall 211 from the front to the back to connect said mating space 215, a through hole 217 is further defined on top of said side wall 211 to connect said guiding space 216 with said mating space 215. And a plurality of ribs 218 extends from the front to the back of said main body 210 along the inside surface of said top wall 212.

Figure 5:
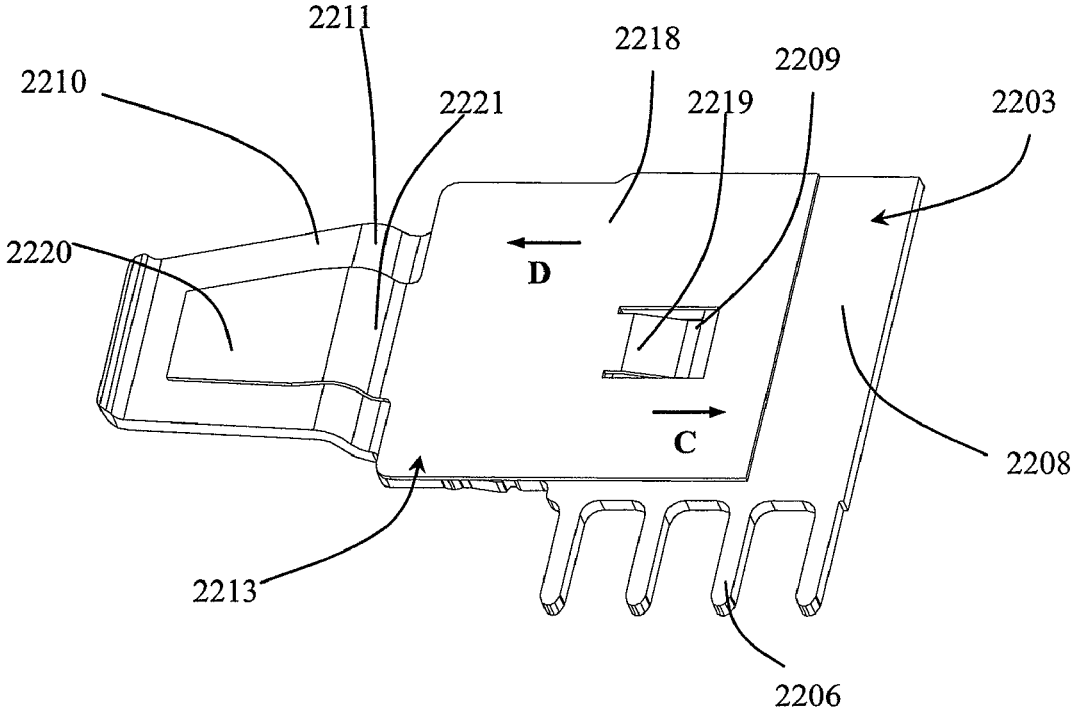
FIG. 5 is a perspective view of a receptacle contact of the receptacle connector according to the present invention.

According to the preferred embodiment of the present invention, said receptacle contacts 221, 222 of said receptacle contact pair 220 are configured fact-to-face and symmetrically mirror each other. Each of said receptacle contact pairs 220 includes a pair of independent receptacle contacts 221, 222. Referring to FIG. 5, said receptacle contact includes a first part 2203 made of high conductive material and a second part 2213 made of high mechanical material, said first part 2203 being connected with said second part 2213 by a positioning element. According to the preferred embodiment of the present invention, said high conductive material of said first part 2203 is copper, which features at good electrical conductivity and thermal conductivity, and good plastic, and can be easily manufactured by cold-press and hot-press, but the copper has a disadvantage at rigidity and intends to deform under force; the high mechanical material of said second part is stainless steel, which features at high mechanical rigidity and high anti-corrosion, and does not intend to deform under force. Said first part 2203 includes a planar base portion 2208, a pin type mounting leg 2206 extending downwardly from the lower side of said base portion 2208, a contacting portion 2210 with a shape of a narrow at front and wide at back cantilever extending forwardly from the front of said base portion 2208. According to the preferred embodiment of the present invention, each of said receptacle contact has four said mounting legs 2206 extending downwardly from the back edge of said base portion 2208 to be welded on corresponding circuit board by Through-Hole Technology. Of course, the number of said mounting leg 2206 may vary to meet the requirements in different designs according to other embodiments of present invention. Moreover, the way to connect said mounting leg 2206 with circuit board may also be realized by other common technologies, for example, SMT, or Press-fit Technology. Said second part 2213 includes a securing portion 2218 and a supporting portion 2220 extending forwardly from said securing portion 2218. According to the preferred embodiment of the present invention, said securing portion 2218 is a stainless steel sheet firmly attached onto the inner side of the main plane of said contacting portion 2210 of said first part 2203. Said positioning element between said first part 2203 and said second part 2213 includes a first positioning element for securing said base portion 2208 of said first part 2203 and said securing portion 2218 of said second part 2213, and a second positioning element for securing said contacting portion 2210 of said first part 2203 and said supporting portion 2220 of said second part 2213. According to the preferred embodiment of the present invention, said first positioning element includes an opening 2209 (Referring to FIG. 8) defined on said base portion 2208 of said first part 2203 and a resilient clip 2219 defined on said securing portion 2218 of said second part 2213 to be extendingly clipped into said opening 2209, said first positioning element functions at firmly connecting said second part 2213 to said first part 2203 and limiting the lateral movement of said second part 2213 with regard to said first part 2203 in a direction C as shown in FIG. 5. Said second positioning element includes a bending portion 2211 defined at a position where said base portion 2208 of said first part 2203 is connected with said contacting portion 2210, and a stopping portion 2221 defined at a position where said securing portion 2218 of said second part 2213 is connected with said supporting portion 2220, said stopping portion 2221 is firmly attached onto said bending portion 2211 of said first part and limits the lateral movement of said second part 2213 with regard to said first part 2203 in a direction D as shown in FIG. 5.

Figure 6:
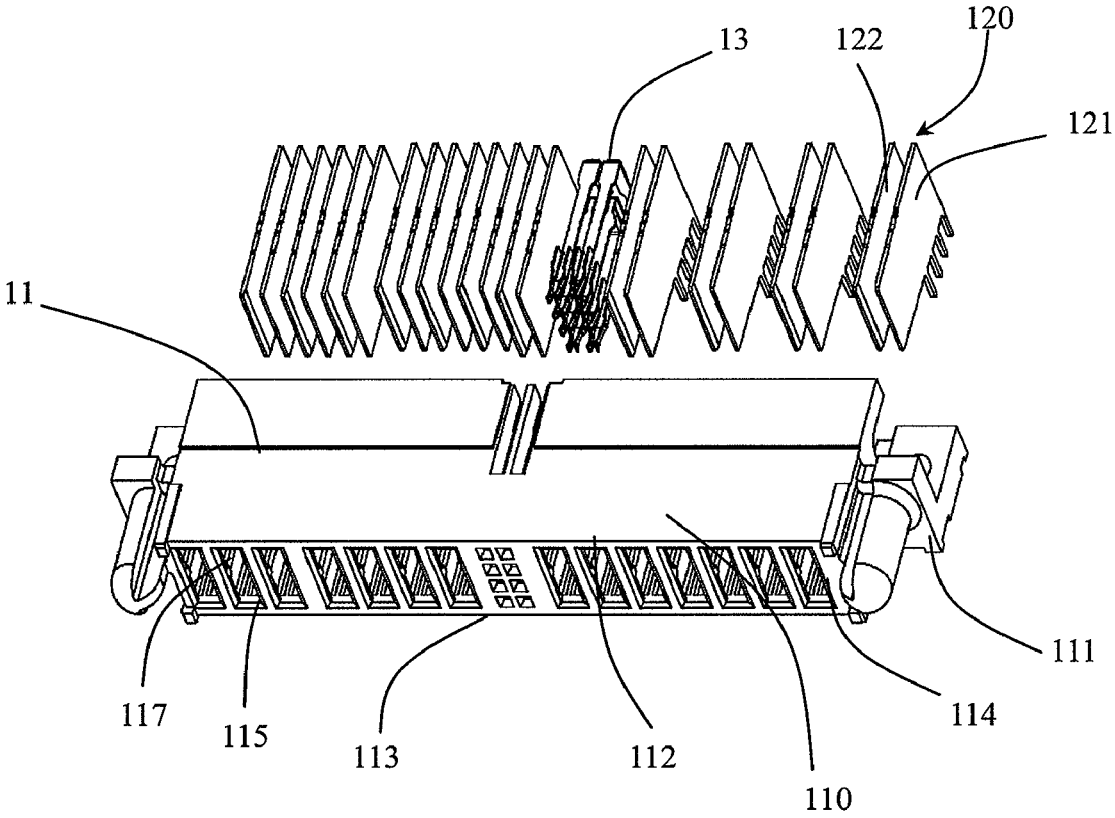
FIG. 6 is an explosively perspective view of a plug connector according to the present invention.

Referring to FIG. 6, said plug connector 1 includes an insulating plug housing 11, plug contact pairs 120 and a second signal contact assembly 13 received in said insulating plug housing 11. Inserted in a plurality of through holes near to the middle of said main body 110 of said insulating plug housing 11, said second signal contact assembly 13 includes a plurality of second signal contacts in an array for transmitting signals, the contacting portion of said second signal contact is configured in two-piece resilient arm for receiving said pin type first signal contact of said receptacle connector 2.

As approximately an injection molded longitudinally cubic plastic body, said insulating plug housing 11 includes a main body 110 for receiving said contacts and side portion 111 in both sides of said main body 110 in a longitudinal direction. Said main body 110 includes a top wall 112, a bottom wall 113 parallel to said top wall 112, two side walls 114 and a row of plurality of spacer 115 between said top wall 112 and said bottom wall 113. Said spacer 115 extends backwardly from the front of said main body 110, contact receiving passage 117 is formed between every two said spacers 115 and has an opening in front of said main body 110.

Figure 7:
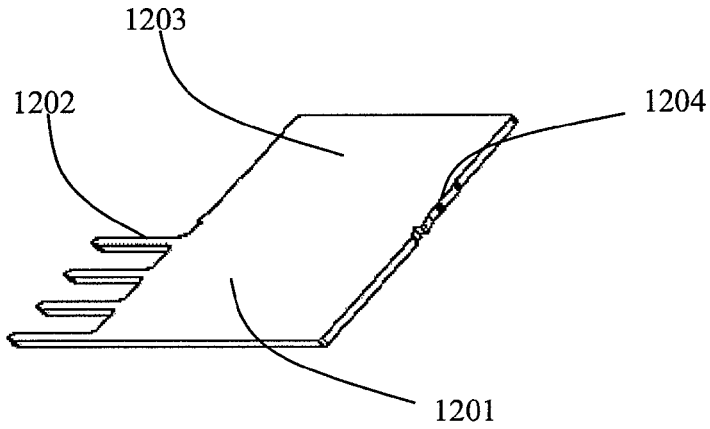
FIG. 7 is a perspective view of a plug contact of the plug connector according to the present invention.

Each of said plug contact pairs 120 includes a pair of independent plug contacts 121, 122. Referring to FIG. 7, each of said plug contact includes a rectangular planar main body 1201, a mounting leg 1202 extending downwardly from said main body 1201, and a contacting portion 1203 extending forwardly from the front of said main body 2201. A contacting area for mating with said receptacle contact of said receptacle connector 2 is formed on inner side of said contacting portion 1203. According to the preferred embodiment of the present invention, each of said plug contacts has four mounting legs 1202 extending downwardly from the back bottom edge of said main body 1201, to be welded to the corresponding circuit board by Through-hole Technology. Of course, the number of said mounting leg 1202 may vary to meet the requirements in different designs according to other embodiments of present invention. Moreover, the way to connect said mounting leg with circuit board may also be realized by other common technologies, for example, SMT, or Press-fit Technology. At the top side and bottom side in front of said main body 1201 a barbed retention portion 1204 is formed respectively. According to the preferred embodiment of the present invention, said plug contacts 121, 122 of said plug contact pair 120 are configured parallel, spaced face-to-face with a predetermined distance to form a mating space 1205 (Referring to FIG. 9), and symmetrically mirrored each other. Said retention portion 1204 on top side edge of said main body 1201 is near to the middle, said retention portion 1204 on bottom side edge of said main body 1201 is in front of said mounting leg 1202, a guiding portion 1206 (Referring to FIG. 9) is formed from a chamfer in front of said contacting portion 1203 of said plug contact.

Figure 8:
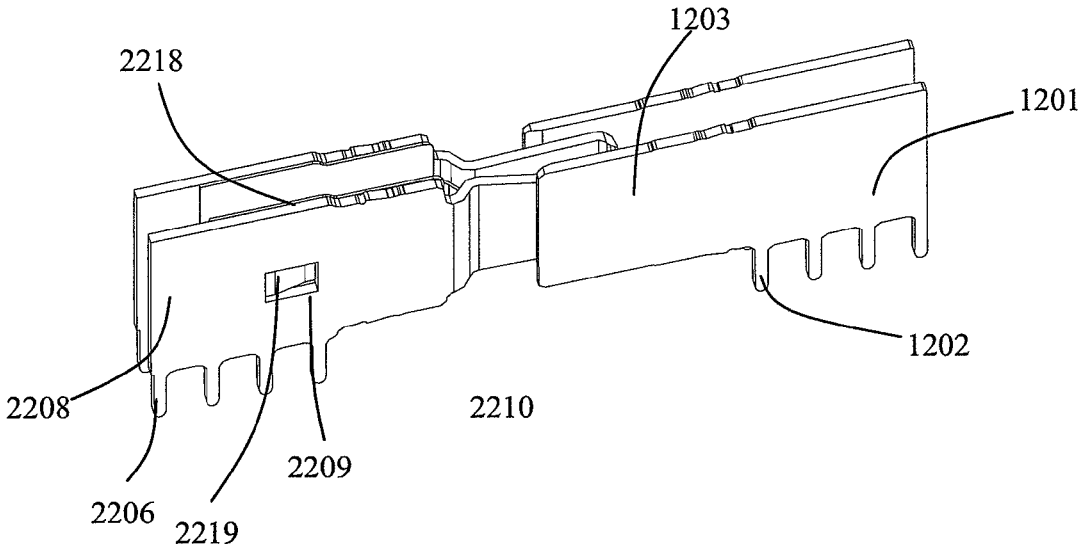
FIG. 8 is a perspective view of an assembly of the receptacle contact of the receptacle connector mated with the plug contact of the plug connector according to the present invention.
Figure 9:
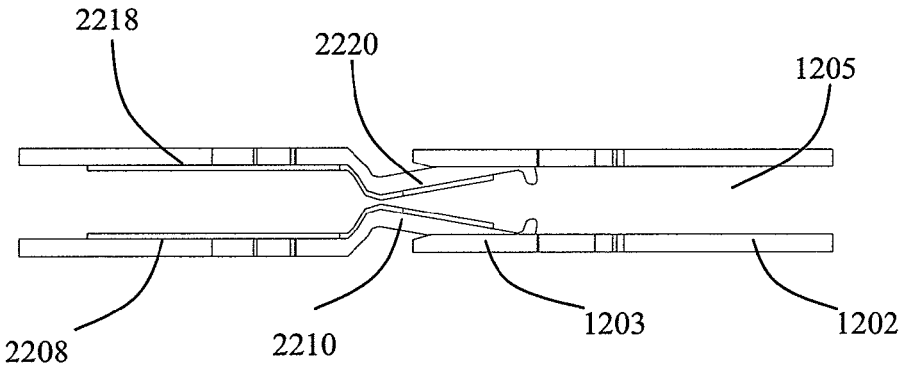
FIG. 9 is a top plan view of FIG. 8.
Figure 10:
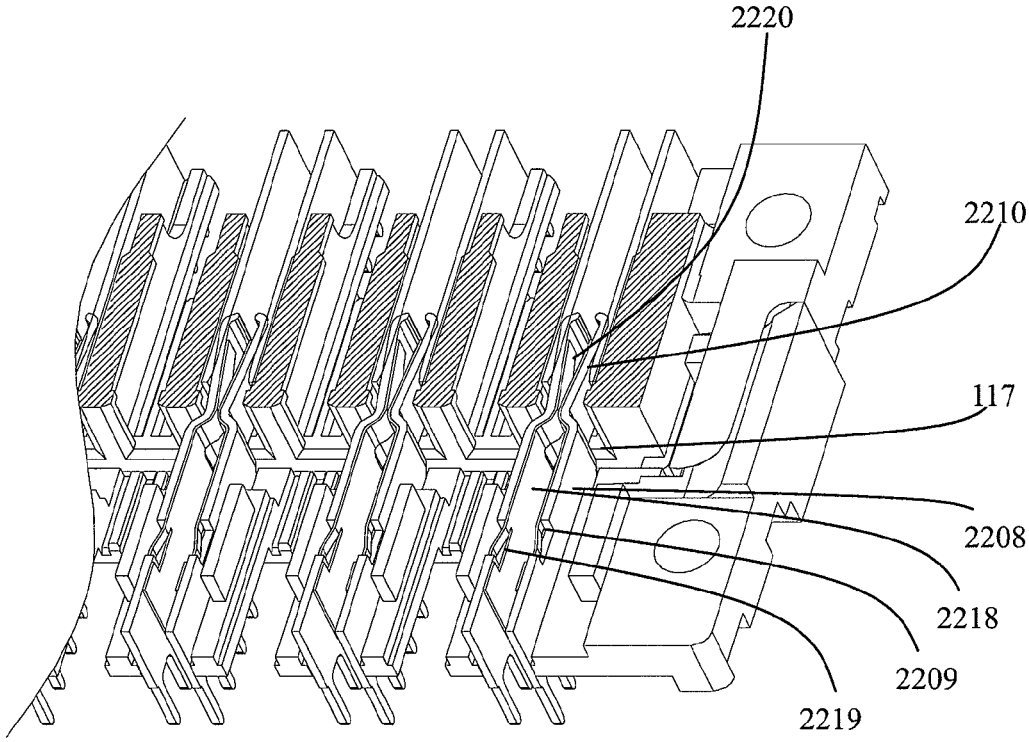
FIG. 10 is a partial cross-sectional view of a power connector assembly taken along the line A-A of FIG. 3.
Figure 11:
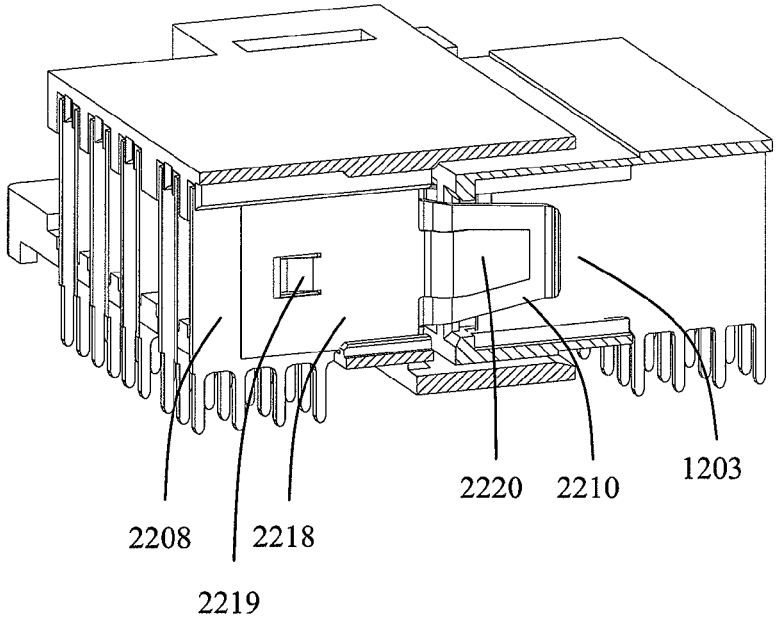
FIG. 11 is a partial cross-sectional view of a power connector assembly taken along the line B-B of FIG. 3.

Referring to FIGS. 8 and 9, when said receptacle contact pair 220 is mated with said plug contact pair 120, said contacting portion 2210 of said first part 2203 of said receptacle contacts 221, 222 is inserted in said mating space 1205 of said plug contacts 121, 122, enables said contacting portion 2210 to contact with said contacting portion 1203 of said plug contact 1203. Further referring to FIGS. 10 and 11, since said contacting portion 1203 of said plug contacts 121, 122 are tightly attached to side wall of said contact receiving passage 117 and secured in said contact receiving passage 117 by said retention portion 1204, said main body 1201 and said contacting portion 1203 of said plug contacts 121, 122 will not deform when said receptacle contacts 221, 222 are inserted, whereas the sum of the width of two said contacting portion 2203 of said receptacle contacts 221, 222 is slightly larger than that of the mating space 1205 of said plug contacts 121, 122, therefore two said contacting portion 2210 of said receptacle contacts 221, 222 will inevitably be bent to each other under the force of said contacting portion 1203 of said plug contacts 121, 122. Correspondingly, due to the reason that said supporting portion 2220 of said second part 2213 of said receptacle contacts 221, 222 is made of high rigidity stainless steel, it can provide an opposite supporting force to said deformed contacting portion 2210 of said first part 2203, so as to offset the pressing force exerted on said contacting arm 2210 of said receptacle contacts 221, 222 by the contacting portion 1203 of said plug contacts 121, 122, and to reduce the deformation of the contacting arm 2210 of said receptacle contacts 221, 222.

According to present invention, said receptacle contact of the power connector is configured in two pieces, and made of two different materials. The advantages of two-piece configuration are that the contacts can be manufactured by a continuous injection mould without the worry about the problems occurred when being bent, therefore the quality can be effectively improved, and the cost of manufacturing can be lowered as well, at the same time, it makes the assembly and manufacturing process easier but ensures the quality, meanwhile the contacts can transmit higher voltage and current under the specification of material conductive characteristics; furthermore, the advantages of said first and said second parts made of different material are that said first part made of high conductive material ensures to meet the requirements of contact for transmitting power, and said second part with high mechanical characteristics prevents the contact from over deforming under force exerted when the contacts being contacted, so as to ensure the reliability of power transmission.

While the description as set forth is only a preferred embodiment of the present invention, it can also achieved by other various embodiments, for example, the position and structure of said positioning element between said first part and said second part of said conductive contact can be adjusted to meet the requirements in other embodiments, for instance, said second part can be attached onto said first part to save the process of cutting the opening and arranging the resilient clip on said first part and said second part. For another example, the high conductive material of said first part could also be an alloy or other material coated with gold, while the material of said high mechanical second part could be other different stainless steel. For a further example, said plug connector 1 and said receptacle connector 2 can also be configured in that one of them is assembled on main board or other circuit boards, and the other is connected with a cable, in other words, one of the mounting legs of said receptacle contact could be replaced by a common structure used to connect with a cable. Any equivalent modifications made by a person skilled in the art according to the teaching of the present invention should be construed to be included within the scope or spirit of the appended claims as defined in the present invention.

What is claimed is:

1. A power connector, comprising:

an insulating housing having a plurality of contact receiving passages, a contact pair having a pair of independent conductive contacts received in one of said plurality of contact receiving passages, said pair of independent conductive contacts spaced from each other a predetermined distance and mirroredly received in the same one of said contact receiving passages; wherein each independent conductive contact includes a first part made of high conductive material and a second part made of high mechanical material.

2. The power connector according to claim 1, wherein the material of said first part is copper and the material of said second part is stainless steel.

3. The power connector according to claim 1, wherein said power connector is a receptacle connector, and said contact pairs are receptacle contact pairs received in said contact receiving passages of said insulating receptacle housing of said receptacle connector.

4. The power connector according to claim 1, wherein said first part is connected with said second part by a positioning element.

5. The power connector according to claim 4, wherein said first part includes a base portion and a contacting portion extending from said base portion.

6. The power connector according to claim 5, wherein said second part includes a securing portion contacted with said base portion of said first part and a supporting portion extending from said securing portion to contact with said contacting portion of said first part.

7. The power connector according to claim 6, wherein said positioning element includes a first positioning element for connecting said base portion of said first part to said securing portion of said second part, and a second positioning element for connecting said contacting portion of said first part to said supporting portion of said second part.

8. The power connector according to claim 7, wherein said first positioning element includes an opening defined on said base portion of said first part and a spring clip defined on said securing portion of said second part to extend into said opening.

9. The power connector according to claim 7, wherein said second positioning element includes a bending portion defined at a position where said base portion of said first part is connected with said contacting portion and a stopping portion defined at a position where said securing portion of said second part is connected with said supporting portion, said stopping portion resting on said bending portion.

10. A power connector assembly, comprising:

a receptacle connector including an insulating receptacle housing and receptacle contact pairs received in contact receiving passages of said insulating receptacle housing, a mating plug connector including an insulating plug housing and plug contact pairs received in contact receiving passages of said insulating plug housing, wherein each of said receptacle contact pairs has a pair of independent receptacle contacts received in a corresponding contact receiving passage of said insulating receptacle housing, each of said receptacle contacts includes a first part and a second part connected with each other by a positioning element, and the material of the first part is high conductive material, and the material of the second part is high mechanical material.

11. The power connector assembly according to claim 10, wherein said first part of said receptacle contact includes a base portion, a resilient contacting arm extending from said base portion, and a bent portion for connecting said base portion to said contacting arm.

12. The power connector assembly according to claim 10, wherein said second part includes a securing portion contacted with said base portion of said first part and a supporting portion extending from said securing portion to contact with said contacting arm of said first part.

13. The power connector assembly according to claim 12, wherein said positioning element includes an opening defined on said base portion of said first part and a resilient clip defined on said securing portion of said second part to extend into said opening.

14. A conductive contact, comprising:

a first part made of high conductive material, said first part having a planar base portion, a pin type mounting leg extending downwardly from a lower side of said planar base portion, and a cantilever contacting portion extending from a forward edge of said planar base portion, and a second part made of high mechanical material, said second part having a planar securing portion abutting against said planar base portion of said first part and a supporting portion extending forwards from said planar securing portion and abutting against said cantilever contacting portion.

15. The conductive contact according to claim 14, wherein said cantilever contacting portion forms a narrower front portion and a wider rear portion connecting to said planar base portion.

16. The conductive contact according to claim 15, wherein said first part and said second part are adhered to each other by glue.

17. The conductive contact according to claim 15, wherein said first part and said second part are connected by a positioning element, and wherein said positioning element includes a first positioning element for connecting said base portion of said first part to said securing portion of said second part, and a second positioning element for connecting said contacting portion of said first part to said supporting portion of said second part.

18. The conductive contact according to claim 17, wherein said first positioning element includes an opening defined on said base portion of said first part and a resilient clip defined on said securing portion of said second part to extend into said opening.

19. The conductive contact according to claim 17, wherein said second positioning element includes a bending portion defined at a position where said base portion of said first part is connected with said contacting portion and a stopping portion defined at a position where said securing portion of said second part is connected with said supporting portion, said stopping portion resting on said bending portion.

* * * * *